United States Patent [19]

Livingston

[11] Patent Number: 4,526,456

[45] Date of Patent: Jul. 2, 1985

[54] APPLICATOR FOR OXIDIZABLE FLUID

[75] Inventor: James J. Livingston, Waltham, Mass.

[73] Assignee: Polaroid Corporation, Cambridge, Mass.

[21] Appl. No.: 529,105

[22] Filed: Sep. 2, 1983

[51] Int. Cl.[3] ..... G03D 9/00

[52] U.S. Cl. ..... 354/317; 354/303; 222/149

[58] Field of Search ..... 354/88, 303, 305, 317; 222/149, 559

[56] References Cited

U.S. PATENT DOCUMENTS

| | | | |
|---|---|---|---|
| 2,435,719 | 2/1948 | Land | 354/303 |
| 2,558,858 | 7/1951 | Land | 354/303 |
| 2,563,343 | 8/1951 | Land | 354/303 |
| 2,614,885 | 10/1952 | Roell et al. | 222/149 |
| 2,719,789 | 10/1955 | Land | 354/86 |
| 3,120,792 | 2/1964 | Erikson | 354/303 |
| 3,142,242 | 7/1964 | Erikson | 354/303 |
| 3,453,138 | 7/1969 | Chen et al. | 117/111 |
| 3,648,584 | 3/1972 | Eacock | 354/303 |
| 3,759,609 | 9/1973 | Eloranta et al. | 352/72 |
| 3,952,927 | 4/1976 | Schaumburg et al. | 222/559 |

*Primary Examiner*—A. A. Mathews

*Attorney, Agent, or Firm*—Leslie J. Payne

[57] ABSTRACT

A fluid applicator is disclosed for intermittently dispensing an oxidizable processing fluid across a photographic sheet. The applicator includes a valve assembly being relatively displaceable with respect to outlet openings formed in a housing between sealing and unsealing conditions. Included in the valve assembly is means which not only cleans the fluid from the opening, but seals such opening when the assembly is in the sealing condition.

7 Claims, 5 Drawing Figures

APPLICATOR FOR OXIDIZABLE FLUID

BACKGROUND OF THE INVENTION

The present invention relates, in general, to fluid applicators and, in particular, fluid applicators of the type usable for intermittently dispensing a controlled amount of processing fluid across a photographic sheet material.

A variety of photographic processes of the self-developing type broadly involve the application of a viscous liquid reagent across exposed photographic sheet material in a predetermined thickness. One known self-developing type process includes exposing a photosensitive film sheet and then superimposing it with a second sheet. Prior to superimposing the two sheets a layer of processing fluid is deposited between the sheets in a thin layer. Superpositioning of the sheets and spreading of the fluid is accomplished by passing sheets between a pair of pressure-applying rollers which guide the sheets along convergent paths into superposition with one another. The spread fluid can initiate formation of visible images within either sheet.

Significant problems arise in connection with the metered application of such processing fluids. One problem is attributable to the fact that such fluids are readily oxidizable. Once oxidized the fluids can harden and, therefore, impede accurate dispensing. Also, such hardening could hamper significantly any desired sliding movement of parts which come into contact with the fluid. This problem is increased somewhat when it is intended to intermittently dispense measured amounts of the fluid over varying periods of time. Accordingly, it is crucial to protect the reagent against contact with the atmosphere when preserving the latter and insuring that build-up of hardened reagent is minimized or eliminated entirely. Moreover, it is significant that the reagent remain free from other contamination and that any hardened reagent not be dispensed onto the sheet.

Furthermore, it is, of course, desirable to achieve the foregoing with an applicator which is simple in construction, reliable in operation and serviced conveniently and quickly.

There have been several known approaches to overcoming the shortcomings inherent in dispensing such fluids. Representative examples of such approaches are disclosed in the following commonly-assigned U.S. Pat. Nos.: 2,435,719; 2,558,858; 2,563,343; 2,719,789; 3,120,792; 3,453,138; 3,142,242; 3,759,609; and 3,648,584.

SUMMARY OF THE INVENTION

It is an object of the present invention to make provision for an improved fluid applicator for reliably and intermittently dispensing precise amounts of a viscous fluid across a photosensitive sheet.

According to the present invention, there is provided a fluid applicator for intermittently dispensing processing fluid for distribution across a photographic film sheet. Included in the applicator is a housing having an interior chamber for at least intermittently storing film processing fluid and an outlet opening extending from the chamber to the exterior of the housing for dispensing fluid from the chamber. This outlet opening has a given cross section and length as viewed in the direction of fluid flow through the opening.

A valve assembly is displaceable between sealing and unsealing positions. The valve assembly includes means for cleaning residual fluid through the length of said opening during the sealing thereof. The cleaning means including a tip member closely fitted to the cross section of the opening and configured for displacement during sealing actuation through the length of the opening to an exterior end thereof so as to clean said opening of residual fluid. The tip member being of sufficient length such that a portion thereof remains within the opening in sealing relation thereto when said member reaches an exterior end of the opening.

In an embodiment the tip member is of sufficient length to protrude from the exterior end of said opening. Also, the housing includes a valve seat adjacent an interior end of said opening, and the valve assembly carries a compressible member mounted circumferentially of said tip member for sealing engagement with said valve seat when said valve assembly is in its sealing position.

Among the other objects and features of the present invention are the provisions of an improved fluid applicator for use in intermittently dispensing processing fluid across a photographic sheet; the provision of an improved fluid applicator of the type having a valve which generally simultaneously cleans and seals a dispensing opening thereof; the provision of an improved fluid applicator of the last-noted type which maintains a valve along a predetermined path; the provision of an improved fluid applicator which includes a quick disconnect coupler coupled thereto; and, the provision of an air-tight seal for the valve so as to prevent oxidation of the processing fluid.

Other objects and further scope of applicability of the present invention will become apparent from the detailed description to follow when taken in conjunction with the accompanying drawings wherein like parts are indicated by like reference numerals throughout the several views.

DETAILED DESCRIPTION

Figure 1:
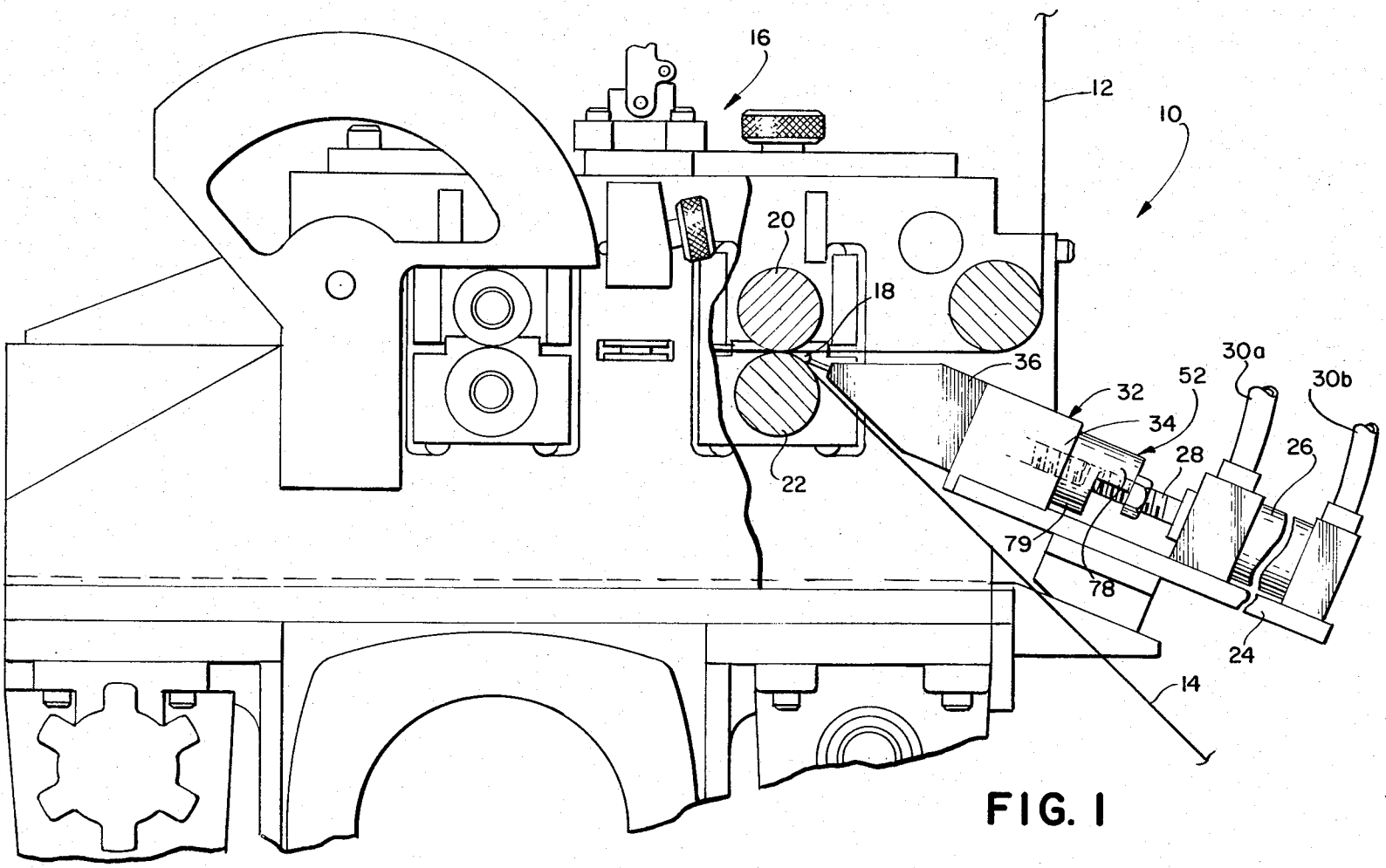
FIG. 1 is a side elevational view, partly in section, showing the improved fluid applicator of the present invention distributing processing fluid to a space adjacent a pair of converging sheets just prior to superpositioning of them.

Reference is now made to FIG. 1 for illustrating a fluid applicator 10 made in accordance with the principles of the present invention. This applicator 10 is particularly useful for intermittently distributing easily oxidizable processing fluid of the type used in instant photography. As depicted in the drawings, the fluid applicator 10 is disposed centrally adjacent to a pair of positive image-receiving and negative image-forming sheets 12 and 14; respectively. These sheets 12 and 14 are being drawn along converging paths, just prior to being superimposed, by a processing assembly indicated generally by reference numeral 16. Insofar as the processing assembly 16 and the manner the sheets 12, 14 are brought into superposed relationship do not form an aspect of the present invention, a detailed description thereof has been dispensed with. However, only those aspects thereof necessary for an understanding of the present invention will be set forth.

In this embodiment the photosensitive negative sheet 14 is of the type which includes a plurality of layers having a photosensitive layer which has been photographically exposed in a desired area previously in a camera and which, of course, carries the latent images thereon. The positive or image-receiving sheet 12 is made of material which can carry thereon a positive transfer print. To effect such a transfer from the negative to the positive a processing fluid 18 is spread between the sheets 12, 14 and the sheets are kept superposed for at least a preselected imbibition period. The processing fluid 18 facilitates the transfer of images. The processing fluid 18 is a relatively viscous and easily oxidizable material. Spreading of the processing fluid 18 into a uniform layer is achieved by a pair of pressure applying rollers 20, 22 which have a predetermined gap set forth therebetween and which form part of the processing assembly 16. As noted, the pressure applying rollers 20 and 22 facilitate not only superimposing of sheets 12, 14 but spreading of such fluid. It should be pointed out that subsequent to imbibition, the sheets 12 and 14 are stripped by means not shown and not forming part of the present invention. Although the present embodiment has disclosed that the visible images will be formed on the positive sheet 12, it is also contemplated by the present invention that the visible images may be formed in the negative sheet material. In this regard, the sheet 12 would serve to spread the processing fluid thereon.

Reference is also made to FIGS. 2–5, along with FIG. 1. As depicted, the fluid applicator 10 is mounted on a supporting platform 24. Also mounted on the supporting platform 24 is a fluid motor 26. A threaded connecting drive shaft 28 is integrally connected to a piston (not shown) formed in the cylinder of the motor 26. Through suitable inlet/outlet openings 30*a,b* fluid is alternately introduced and exhausted from opposite ends of the piston. As a result, the piston reciprocates and causes the drive shaft 28 to similarly translate for operating the fluid applicator 10 in a manner which will be set forth. It is, of course, within the scope of the present invention that instead of a fluid motor other types of motion producing apparatus may be used.

The fluid applicator 10 includes a valve housing assembly 32 secured to the platform 24 and having a generally rectangular body portion 34 and a replaceable valve head 36 with converging wall surfaces being attached to the body portion. A plurality of linearly spaced outlet openings 38 are formed in the valve housing 34 at the tip or apex of the converging walls of the valve head 36. In this embodiment, there are three outlet openings 38 which serve to distribute the fluid 18 across the sheets in a layer or meniscus. See FIG. 1. As perhaps better illustrated in FIG. 4, the outlet openings 38, one of which is shown, is defined as generally cylindrical passageways having a given length and cross-section. Formed by the interior surfaces of the converging walls are conical valve seats 40. Each of the valve seats 40 is formed adjacent interior ends of the openings 38. The valve housing assembly 32 is formed with an internal chamber 42 which receives thereinto the processing fluid from an inlet 44 thereto. A suitable pumping means (not shown) is responsible for introducing the processing fluid under pressure to the internal chamber 42 for subsequent metered dispensing through the outlet openings 38, when the latter are in their open or unsealing condition. The chamber 42 is arranged to store the fluid when the openings are closed.

Figure 4:
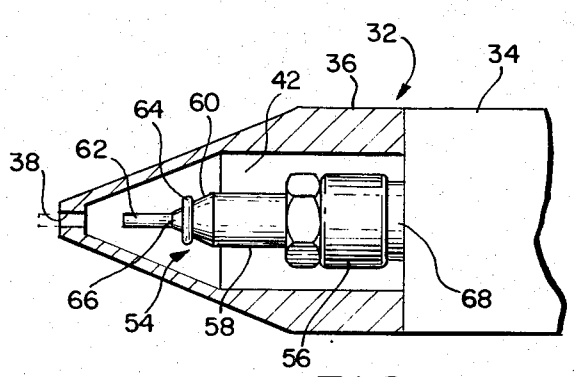
FIG. 4 is an enlarged fragmentary view, partly in section, better illustrating details of the applicator of the present embodiment; and, FIG. 5 is a cross-sectional view taken along the section line 5—5 appearing in FIG. 2 and showing further details of the present invention.
Figure 5:
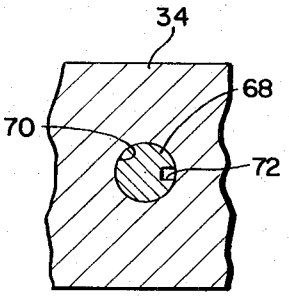
Figure 2:
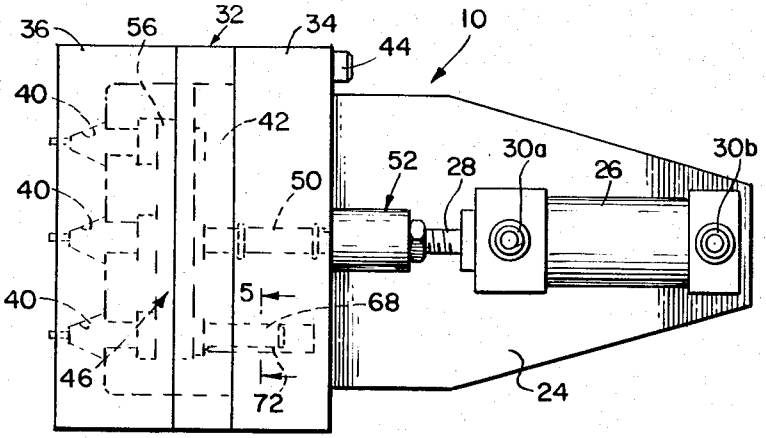
FIG. 2 is a plan view showing in greater detail features of the fluid applicator shown in FIG. 1.
Figure 3:
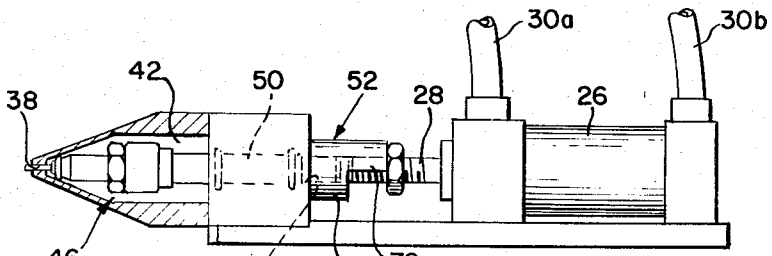
FIG. 3 is a side elevational view, partly in section of the applicator shown in FIGS. 1 and 2.

The fluid applicator 10 includes a valve assembly 46 linearly displaceable between extended, sealing, and retracted, unsealing conditions. When in the retracted position, such as shown in FIG. 4, the processing fluid is free to be pumped through the openings 38 and form the puddle of processing fluid in a space immediately adjacent the gap between the rollers 20, 22. When the valve assembly 46 is moved to the extended position (FIGS. 2 and 3), it serves to seal the processing fluid 18 within the internal chamber 42. The valve assembly 46 has a plunger shaft 50 coupled to the drive shaft 28 by a quick-disconnect coupling member 52. Included in the valve assembly 46 is a plurality of valve units 54 which cooperate with respective ones of the openings 38. The valve units 54 have one end suitably threaded to a horizontally disposed bridging member 56. The bridging member 56 has openings (not shown) therein permitting passage of the processing fluid in the chamber 42 so as to minimize any dampening effect as the plunger reciprocates. Each of the valve units 54 is defined by a generally elongated valve pin 58 having a tapered cross-sectional portion 60 and a forward cylindrical pin portion or distal end 62 of reduced diameter, which is constructed so as to have a close fit with respective ones of the openings 38. Moreover, the cylindrical pin portions 62 are of such a length that they have a segment which extends beyond the exterior of the opening 38 as the valve assembly moves to the end of its stroke. Fixedly carried on the tapered portion 60 is a sealing ring 64. A nub 66 holds the sealing ring against the tapered portion 60. The sealing ring 64 can be a compressible O-ring type seal surrounding the circumference of the tapered portion 60. The sealing ring 64 is held in place so as to insure that it is not axially displaced when it engages the valve seat 40. Should sealing ring displacement occur there is a probability that the ring would not tightly abut against the valve seat 40 for effecting a desired seal when the valve assembly 46 is in the extended position.

In this embodiment, the pin portion 62 has a sliding fit, so as to scrape or wipe clean the surfaces of the housing defining the opening 38 of any residual processing fluid as the pin 62 travels through the opening, such as when the valve assembly 46 is being advanced to the extended or sealing condition.

Furthermore, since the wiping or cleaning pin 62 has a relatively tight sliding fit with the opening 38 there is in effect provided a sealing relationship. Such sealing action substantially inhibits leakage of the processing fluid. It is possible some air or other contaminants may leak through such a sealing relationship, but it is to be noted that the seal provided by the sealing ring 64 is arranged to be impervious to such air leaking into the chamber. As earlier noted, the pin 62 is of a length that a segment thereof is arranged to protrude from the opening 38 when the valve assembly is in its sealing condition. This is done so to puncture any filmy build-up of oxidized residue covering the opening 38. Cleaning and sealing of the openings 38 are extremely important not only for accurate dispensing but because the processing fluid is highly oxidizable and is intended to be dispensed intermittently. Clearly, the potential exists that the processing fluid 18 could harden and in such a hardened form prevent the proper functioning of the valve assembly.

Since there is a close fit between the pin and the openings, the present invention also includes means for insuring that the valve assembly 46 consistently travels along a generally linear path. Towards this end there is provided a guiding shaft 68 extending generally rearwardly from the bridge member 56 and having a tight sliding fit within an opening 70 formed in the body portion 34. A tight-fit minimizes any rocking motion of the valve assembly 46. Formed axially in the shaft 68 is a vent passageway 72. The passageway 72 is for purposes of permitting fluid, which might otherwise be trapped in the opening 70, to vent or exhaust into the internal chamber 42 during reciprocation of the guiding shaft 68. Accordingly, the vent passageway 72 extends from the rearward surface of the guiding shaft 68 to a point which is external or remote from the opening 70 when the valve assembly 46 is in the unsealing condition. The vent 72 minimizes any dampening effect which would otherwise retard valve assembly 46 movement.

Reference is made back again to the quick-disconnect coupler 52 which, as previously noted, couples the plunger shaft 50 to the driving shaft 28. The coupler 52 also serves to limit movement of the valve assembly 46 to the extended position by abutting against the valve body portion 34.

The quick-disconnect coupling member 52 is formed with a cylindrical portion 74 having a threaded bore 76 and a semi-cylindrical portion 78 having a threaded section which is a continuation of the threaded bore 76. The cylindrical portion 74 is adapted to threadedly cooperate with the plunger shaft 50, while the semi-cylindrical portion 78 threadedly cooperates with the shaft 28. Because of the semi-cylindrical configuration, a user can easily lift the coupling member 52 from the threaded drive shaft 28, thus, effecting a quick disconnect. The coupling member 52 can be secured to the plunger shaft 28 by a set screw, not shown.

It is believed that the operation of the fluid applicator 10 is evident based upon the foregoing detailed description. However, to summarize briefly its operation, it will be appreciated that when the valve assembly is displaced between extended and retracted positions it is sealingly closed and unsealingly opened; respectively. In the open position, a pumping means (not shown) pumps the processing fluid 18 through the inlet opening 44 into the interior chamber 42 and eventually out the outlet openings 38 in the form of a puddle or meniscus. When it is desired to close the applicator 18, the fluid motor 26 is operated so that the valve assembly 46 moves to its sealing condition. When moving to this condition, the valve pins 62 clean the openings 38 of any residual processing fluid as well as serves to seal such opening. The pins 62 by extending beyond the openings 38 can punch through any thin filmy build-up covering such openings. It will be appreciated that the valve pins or members 62 form sealing and cleaning means for the openings 38. It will be appreciated that when pin 62 enters an opening it initially effects a seal. Additionally, the sealing rings 64 come into an air-tight sealing contact with the respective valve seats 40 to further insure that there is no leakage or contamination by air of the fluid in the chamber 42.

Since certain changes may be made in the above-described apparatus without departing from the scope of the invention herein involved, it is intended that all matter contained in the description or shown in the accompanying drawings shall be interpreted as illustrative and not in a limiting sense.

What is claimed is:

1. An applicator for intermittently dispensing processing fluid for distribution across a photographic film sheet, said applicator comprising:

a housing having an interior chamber for at least intermittently storing film processing fluid and an outlet opening extending from said chamber to the exterior of said housing for dispensing fluid from said chamber, said outlet opening having a given cross section and length as viewed in the direction of fluid flow through said opening; and, a valve assembly displaceable between sealing and unsealing positions, said valve assembly including means for cleaning residual fluid through the length of said opening during the sealing thereof, said cleaning means including a tip member of said valve assembly closely fitted to the cross section of said opening and configured for displacement during sealing actuation through the length of said opening to the exterior end thereof so as to clean said opening of residual fluid, and said tip member being of sufficient length such that a portion thereof remains within said opening in blocking relation thereto when said member reaches said exterior end of said opening wherein the interior end of said opening includes a valve seat, and said valve member carries a compressible member mounted circumferentially of said tip member at the exterior end thereof for sealing engagement with said valve seat when said valve assembly is in its sealing position.

2. The applicator of claim 1 wherein said housing includes a plurality of outlet openings, a valve assembly associated with each of said outlet openings, and a reciprocally mounted plunger coupled to said valve assemblies for common movement thereof between their sealing and unsealing positions.

3. The applicator of claim 1 wherein said tip member is of sufficient length to protrude from the exterior end of said opening.

4. An applicator for intermittently distributing oxidizable processing fluid across a photographic film sheet, said applicator comprising:

a housing defining a chamber for receiving the fluid, an inlet opening to said chamber for allowing the fluid to be pumped to said chamber, an outlet opening from said chamber for allowing distribution of the pumped fluid to the sheet; and, a valve assembly relatively displaceable with respect to said housing between sealing and unsealing conditions; said assembly including means for cleaning the fluid from said opening and sealing said outlet opening; said sealing and cleaning means including a distal end portion being sized and configured to cooperate with portions of said housing defining said outlet opening so as to clean said opening of residual fluid during at least a portion of the relative displacement of said assembly with respect to said housing and to form a primary sealing relationship with said housing portions to seal said outlet opening when said assembly is in said sealing condition wherein the interior end of said opening includes a valve seat, and said valve member carries a compressible member mounted circumferentially of said tip member at the exterior end thereof for sealing engagement with said valve seat when said valve assembly is in its sealing position.

5. An applicator for intermittently distributing oxidizable processing fluid across a photographic film sheet, said applicator comprising:

a housing defining a chamber for receiving the processing fluid, an inlet opening to said chamber for allowing the fluid to be pumped to said chamber, an outlet opening from said chamber for allowing distribution of the pumped fluid to the sheet and said housing defining an interior valve seat adjacent each of said outlet openings;

a valve assembly relatively displaceable with respect to said housing between sealing and unsealing conditions; said assembly including means for cleaning and sealing said outlet opening; said sealing and cleaning means including a distal end portion being sized and configured to cooperate with portions of said housing defining said outlet opening so as to clean said opening of residual fluid during at least a portion of the relative displacement of said assembly with respect to said housing and to form a primary sealing relationship with said housing portions to seal said outlet opening when said assembly is in said sealing condition; and, said valve assembly including a sealing member fixedly mounted adjacent said distal end portion and being constructed, sized and arranged so as to form a secondary air-tight sealing relationship with said valve seat when said valve assembly is in said sealing condition so as to prevent air from reaching the oxidizable fluid in said chamber when said assembly is in said sealing condition wherein said valve assembly includes a plunger to which said cleaning and sealing means is connected to and further including means for maintaining said plunger in a given path during movement of said plunger between the sealing and unsealing conditions, said maintaining means includes a guiding shaft connected to said plunger and a guide opening formed in said housing and in which said guiding shaft translates as said plunger moves between the sealing and unsealing conditions, said guiding shaft defining a vent passage therealong which vents any fluid trapped in a space between an end portion of said guiding shaft and said opening when said plunger moves to the unsealing condition.

6. The applicator of claim 5 wherein said distal end portion is arranged so that a segment thereof protrudes from said outlet opening when said plunger is in the sealing condition, whereby said protruding segment can puncture a filmy build-up of processing fluid covering said outlet opening.

7. The applicator of claim 5 further including a coupling assembly, said plunger including a plunger shaft extending from said housing, said coupling assembly having an end portion coupled to said plunger shaft, and another end portion adapted to cooperate with a threaded portion of a driving member so that said coupling assembly couples said plunger drive shaft to a driving member, said another end portion being defined as a generally semi-cylindrical portion having a central threaded open bore portion which is adapted to threadedly cooperate with the threaded portion of the driving member in such a manner so that said semi-cylindrical portion can transmit driving forces of the driving member yet can be lifted easily off the threaded portion of the driving member.

* * * * *